US006192532B1

(12) United States Patent
Sesser et al.

(10) Patent No.: US 6,192,532 B1
(45) Date of Patent: Feb. 27, 2001

(54) SHOWER DRAIN REPLACEMENT DEVICE

(75) Inventors: Gregory L. Sesser; Michael W. Johnson, both of Modesto, CA (US)

(73) Assignee: Plumbrite, Inc., Modesto, CA (US)

( * ) Notice: Subject to any disclaimer, the term of this patent is extended or adjusted under 35 U.S.C. 154(b) by 0 days.

(21) Appl. No.: 09/502,289

(22) Filed: Feb. 11, 2000

Related U.S. Application Data

(63) Continuation-in-part of application No. 09/224,321, filed on Dec. 31, 1998, now abandoned.

(51) Int. Cl.[7] ..... A47K 1/14; E03C 1/12
(52) U.S. Cl. ..... 4/679; 285/136.1; 4/286
(58) Field of Search ..... 4/286–292, 613, 4/679, 695; 285/42, 136.1

(56) References Cited

U.S. PATENT DOCUMENTS 3,680,153 * 8/1972 Haldopoulos et al. ..... 4/679
4,850,617 * 7/1989 Moberly ..... 4/288 X

* cited by examiner

*Primary Examiner*—Charles E. Phillips

(57) ABSTRACT

A shower drain replacement device for replacing existing shower drains in most shower stalls. The device includes a drain sleeve for inserting into a drain hole of a fixture, and having an open upper end and an open lower end and a peripheral side wall. A peripheral flange extends outwardly from the upper end for resting on a portion of the fixture adjacent to the drain hole. A plurality of mounting assemblies are provided for securing the drain sleeve in the drain hole of the fixture. Each of the mounting assemblies comprises an aperture in the flange of the drain sleeve, a support sleeve mounted on the drain sleeve, a rod extending through the aperture and through the support sleeve, and a mounting member rotatably mounted on the rod. The mounting member is rotatable between a retracted position and an extended position. Rotation of the rod rotates the mounting member from a retracted position to an extended position abutted against the rib, and further rotation of the rod advances the mounting member toward the flange for pinching the rim of the drain hole between the flange and the mounting member.

12 Claims, 3 Drawing Sheets

SHOWER DRAIN REPLACEMENT DEVICE

CROSS REFERENCE TO RELATED APPLICATION

This application is a continuation-in-part of application Ser. No. 09/224,321, filed Dec. 31, 1998 abandoned.

BACKGROUND OF THE INVENTION

1. Field of the Invention

The present invention relates to shower drains and more particularly pertains to a new shower drain replacement device for replacing existing shower drains in most shower stalls.

2. Description of the Prior Art

The use of shower drains is known in the prior art. More specifically, shower drains heretofore devised and utilized are known to consist basically of familiar, expected and obvious structural configurations, notwithstanding the myriad of designs encompassed by the crowded prior art which have been developed for the fulfillment of countless objectives and requirements.

Known prior art shower drains include U.S. Pat. No. 4,006,498 to Cuschera; U.S. Pat. No. 4,261,84 to Cuschera; U.S. Pat. No. 4,329,744 to Cuschera; U.S. Pat. No. 4,984,309 to Lowry; U.S. Pat. No. 3,937,497 to Studer; and U.S. Pat. No. 4,043,354 to Brown.

While these devices fulfill their respective, particular objectives and requirements, the aforementioned patents do not disclose a new shower drain replacement device. The inventive device includes a drain sleeve for inserting into a drain hole of a fixture. The drain sleeve comprises an open upper end, an open lower end and a peripheral side wall extending between the upper and lower ends. A peripheral flange extends outwardly from the upper end for resting on a portion of the fixture adjacent to the drain hole. A plurality of mounting assemblies are for securing the drain sleeve in the drain hole of the fixture. Each of the mounting assemblies comprises. An aperture in the flange of the drain sleeve. A support sleeve mounted on an outer surface of the peripheral side wall of the drain sleeve. The support sleeve comprises a lumen extending through the support sleeve. A rod extends through the aperture in the flange and through the lumen of the support sleeve. The rod is rotatable with respect to the flange. The rod comprises a portion with a threaded exterior surface. A mounting member is rotatably mounted on the rod. The mounting member is rotatable by rotation of the rod between a retracted position and an extended position. The retracted position is characterized by the mounting member being positioned adjacent to the peripheral side wall. The retracted position permits insertion of the drain sleeve into the drain hole. The extended position is characterized by the mounting member being extended substantially radially outward from the peripheral side wall for permitting an engaging surface of the mounting member to engage the underside of a rim about the drain hole in the fixture. A rib extends radially outward from an outer surface of the peripheral side wall. The rib restricts the rotation of the mounting member beyond the extended position. Rotation of the rod rotates the mounting member from a retracted position to an extended position abutted against the rib, and further rotation of the rod advances the mounting member toward the flange for pinching the rim of the drain hole between the flange and the mounting member.

In these respects, the shower drain replacement device according to the present invention substantially departs from the conventional concepts and designs of the prior art, and in so doing provides an device primarily developed for the purpose of replacing existing shower drains in most shower stalls.

SUMMARY OF THE INVENTION

In view of the foregoing disadvantages inherent in the known types of shower drains now present in the prior art, the present invention provides a new shower drain replacement device construction wherein the same can be utilized for replacing existing shower drains in most shower stalls.

The general purpose of the present invention, which will be described subsequently in greater detail, is to provide a new shower drain replacement device and method of installation which has many of the advantages of the shower drains mentioned heretofore and many novel features that result in a new shower drain replacement device which is not anticipated, rendered obvious, suggested, or even implied by any of the prior art shower drains, either alone or in any combination thereof.

To attain this, the present invention generally comprises a drain sleeve for inserting into a drain hole of a fixture. The drain sleeve comprises an open upper end, an open lower end and a peripheral side wall extending between the upper and lower ends. A peripheral flange extends outwardly from the upper end for resting on a portion of the fixture adjacent to the drain hole. A plurality of mounting assemblies are for securing the drain sleeve in the drain hole of the fixture. Each of the mounting assemblies comprises. An aperture in the flange of the drain sleeve. A support sleeve mounted on an outer surface of the peripheral side wall of the drain sleeve. The support sleeve comprises a lumen extending through the support sleeve. A rod extends through the aperture in the flange and through the lumen of the support sleeve. The rod is rotatable with respect to the flange. The rod comprises a portion with a threaded exterior surface. A mounting member is rotatably mounted on the rod. The mounting member is rotatable by rotation of the rod between a retracted position and an extended position. The retracted position is characterized by the mounting member being positioned adjacent to the peripheral side wall. The retracted position permits insertion of the drain sleeve into the drain hole. The extended position is characterized by the mounting member being extended substantially radially outward from the peripheral side wall for permitting an engaging surface of the mounting member to engage the underside of a rim about the drain hole in the fixture. A rib extends radially outward from an outer surface of the peripheral side wall. The rib restricts the rotation of the mounting member beyond the extended position. Rotation of the rod rotates the mounting member from a retracted position to an extended position abutted against the rib, and further rotation of the rod advances the mounting member toward the flange for pinching the rim of the drain hole between the flange and the mounting member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new shower drain replacement device and method if installation which has many of the advantages of the shower drains mentioned heretofore and many novel features that result in a new shower drain replacement device which is not anticipated, rendered obvious, suggested, or even implied by any of the prior art shower drains, either alone or in any combination thereof.

It is another object of the present invention to provide a new shower drain replacement device which may be easily and efficiently manufactured and marketed.

It is a further object of the present invention to provide a new shower drain replacement device which is of a durable and reliable construction.

An even further object of the present invention is to provide a new shower drain replacement device which is susceptible of a low cost of manufacture with regard to both materials and labor, and which accordingly is then susceptible of low prices of sale to the consuming public, thereby making such shower drain replacement device economically available to the buying public.

Still yet another object of the present invention is to provide a new shower drain replacement device which provides in the apparatuses and methods of the prior art some of the advantages thereof, while simultaneously overcoming some of the disadvantages normally associated therewith.

Still another object of the present invention is to provide a new shower drain replacement device for replacing existing shower drains in most shower stalls.

Yet another object of the present invention is to provide a new shower drain replacement device which includes a drain sleeve for inserting into a drain hole of a fixture. The drain sleeve comprises an open upper end, an open lower end and a peripheral side wall extending between the upper and lower ends. A peripheral flange extends outwardly from the upper end for resting on a portion of the fixture adjacent to the drain hole. A plurality of mounting assemblies are for securing the drain sleeve in the drain hole of the fixture. Each of the mounting assemblies comprises. An aperture in the flange of the drain sleeve. A support sleeve mounted on an outer surface of the peripheral side wall of the drain sleeve. The support sleeve comprises a lumen extending through the support sleeve. A rod extends through the aperture in the flange and through the lumen of the support sleeve. The rod is rotatable with respect to the flange. The rod comprises a portion with a threaded exterior surface. A mounting member is rotatably mounted on the rod. The mounting member is rotatable by rotation of the rod between a retracted position and an extended position. The retracted position is characterized by the mounting member being positioned adjacent to the peripheral side wall. The retracted position permits insertion of the drain sleeve into the drain hole. The extended position is characterized by the mounting member being extended substantially radially outward from the peripheral side wall for permitting an engaging surface of the mounting member to engage the underside of a rim about the drain hole in the fixture. A rib extends radially outward from an outer surface of the peripheral side wall. The rib restricts the rotation of the mounting member beyond the extended position. Rotation of the rod rotates the mounting member from a retracted position to an extended position abutted against the rib, and further rotation of the rod advances the mounting member toward the flange for pinching the rim of the drain hole between the flange and the mounting member.

Still yet another object of the present invention is to provide a new shower drain replacement device that is strong and durable.

Even still another object of the present invention is to provide a new shower drain replacement device that is easy to install.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
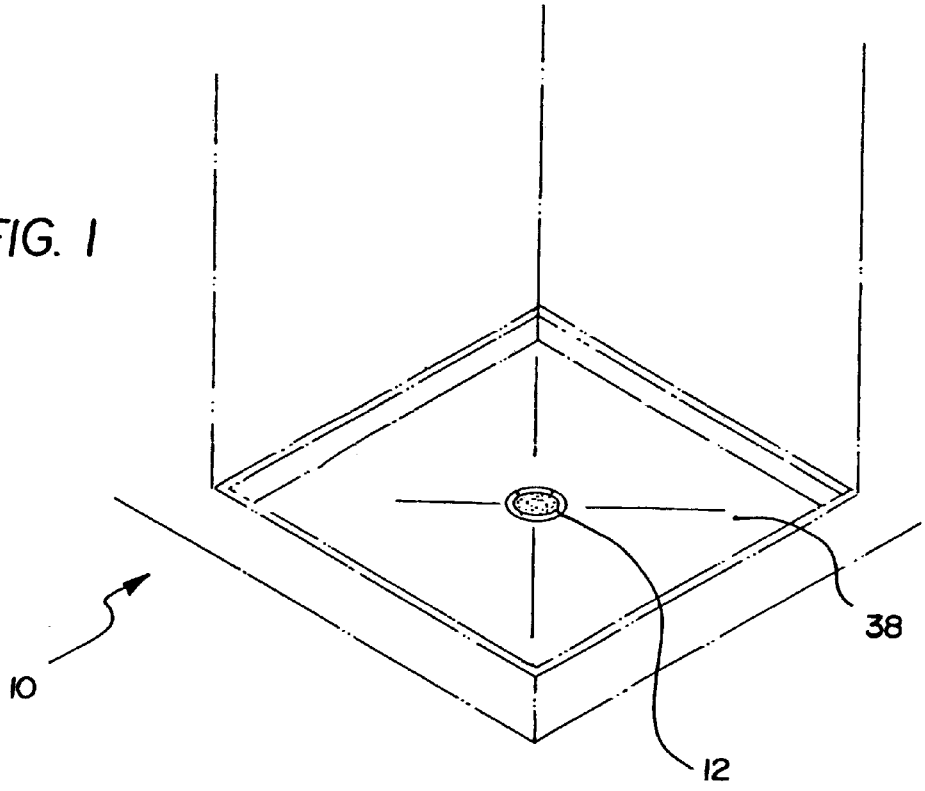
FIG. 1 is a perspective view of a new shower drain replacement device according to the present invention shown installed in a shower stall.
Figure 2:
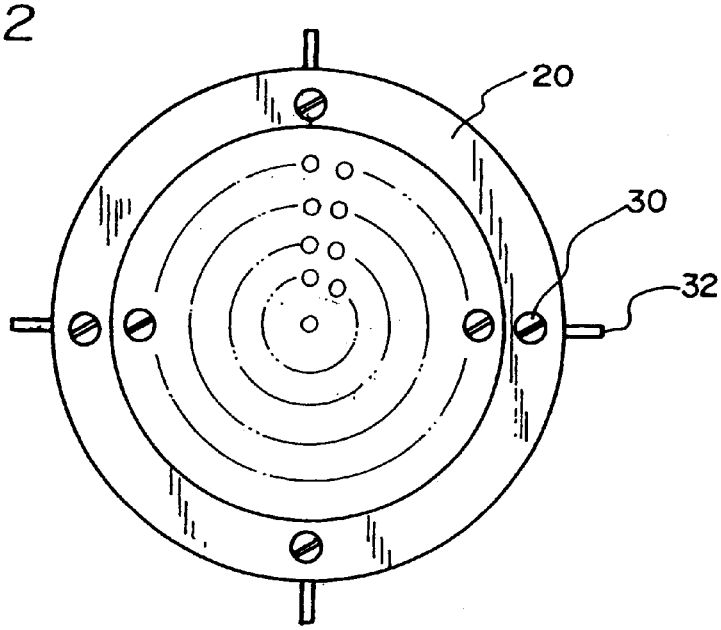
FIG. 2 is a top plan view of the present invention.

With reference now to the drawings, and in particular to FIGS. 1 through 6 thereof, a new shower drain replacement device embodying the principles and concepts of the present invention and generally designated by the reference numeral 10 will be described.

As best illustrated in FIGS. 1 through 6, the shower drain replacement 10 comprises a drain sleeve 12 for inserting into a drain hole of a fixture. The drain sleeve comprises an open upper end 14, an open lower end 16 and a peripheral side wall 18 extending between the upper and lower ends. A peripheral flange 20 extends outwardly from the upper end for resting on a portion of the fixture adjacent to the drain hole. The peripheral side wall comprises an outer surface and a thickness. The thickness of the peripheral side wall tapers 24 toward the lower end of the drain sleeve for facilitating insertion of the lower end into the drain hole of the fixture.

Figure 3:
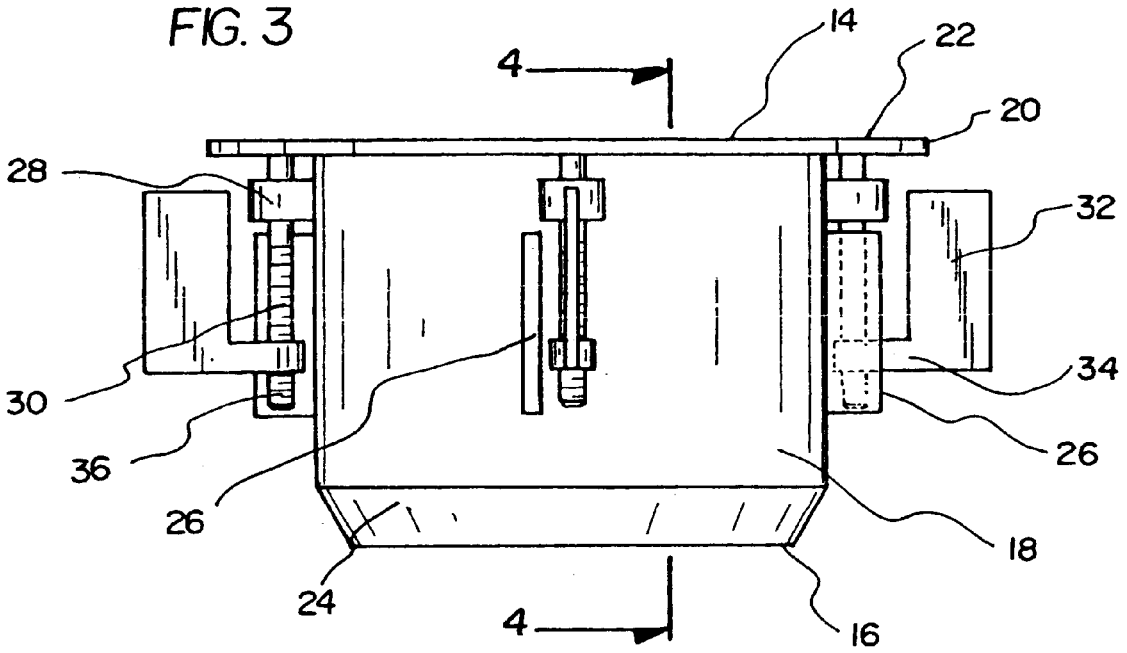
FIG. 3 is a side elevation view of the present invention.
Figure 4:
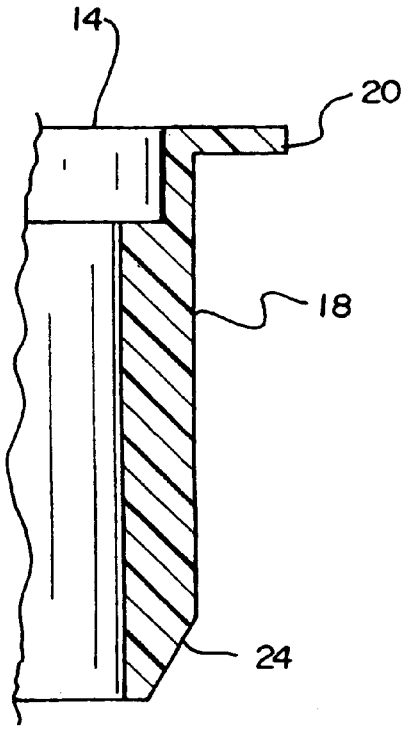
FIG. 4 is a cross-sectional view of the present invention as taken along line 4—4 of FIG. 3.
Figure 5:
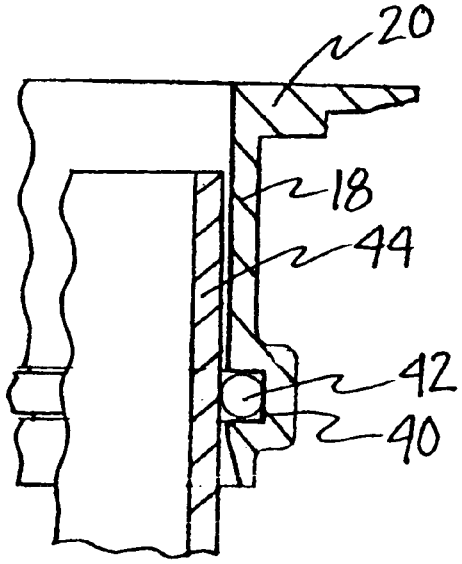
FIG. 5 is a partial cross-sectional view of the present invention showing an optional elastomeric ring seal in relation to a drain pipe.

As shown in FIG. 3, a plurality of mounting assemblies are for securing the drain sleeve in the drain hole of the fixture. Each of the mounting assemblies comprises an aperture 22 in the flange of the drain sleeve. A support sleeve 28 is mounted on the outer surface of the peripheral side wall of the drain sleeve. The support sleeve comprises a lumen extending through the support sleeve. The lumen comprises a longitudinal axis passing through a center of the aperture of the flange. It should be noted that the support sleeve may be located adjacent to the peripheral flange, and shown in FIG. 3, or may optionally be positioned in a location toward the lower end 16 of the perimeter side wall.

A rod 30 extends through the aperture in the flange and through the lumen of the support sleeve. The rod comprises a portion with a threaded exterior surface 36. The rod comprises a head portion at one end of the rod for positioning adjacent to the flange. The head portion is enlarged to resist movement of the head portion through the aperture toward the support sleeve. The rod is rotatable with respect to the flange. The head portion of the rod includes a recess therein for accepting a portion of a tool for permitting rotation of the rod by the tool. Optionally, if the support sleeve is positioned a distance away from the peripheral flange, the aperture of the support sleeve may form a recess with a closed end that receives a tip of the rod 30 and prevents the rod from moving through the support sleeve and out of the peripheral flange 20. In this embodiment, a head portion is not needed on the rod for keeping the rod from moving through the peripheral flange, since the closed recess of the support sleeve serves that function.

A mounting member is rotatably mounted on the rod. The mounting member includes a receiving portion 34 for mounting on the rod. The receiving portion comprises a hole therein for receiving a portion of the rod. The receiving portion engages the threaded exterior surface of the portion of the rod such that rotation of the rod advances the mounting member toward the flange. The mounting member may comprise a wing portion 32 mounted on the receiving portion. The wing portion extends from the receiving portion toward the flange.

The mounting member is adapted to rotate with the rod between a retracted position and an extended position. To effect this relationship, the mounting member is adapted to resisting free rotation of the rod with respect to the mounting member. One manner of providing this resistance is through the use of a mechanical deformation of the mounting member to cause a partial interference between the rod and the surface of the hole, so that rotation (e.g., threading) of the rod through the hole is resisted, but not blocked. Another manner of providing the resistance is through the use of a chemical substance applied to the rod and/or the hole that creates a weak but effective bond therebetween so that rotation of the rod with respect to the mounting member is resisted.

The retracted position of the mounting member is characterized by the wing portion being positioned adjacent to the peripheral side wall. The retracted position permits insertion of the drain sleeve into the drain hole. The extended position is characterized by the wing portion being extended substantially radially outward from the peripheral side wall for permitting an engaging surface of the wing member to engage the underside of a rim about the drain hole in the fixture.

A rib 26 extends radially outward from an outer surface of the peripheral side wall. The rib restricts the rotation of the mounting member. The rib is circumferentially offset with respect to the aperture in the flange. The rib is positioned to block rotation of the wing portion of the mounting member beyond the extended position. Rotation of the rod rotates the wing portion of the mounting member from a retracted position to an extended position abutted against the rib and further rotation of the rod advances the wing portion of the mounting member toward the flange for pinching the rim of the drain hole between the flange and the engaging surface of the mounting member. The plurality of mounting assemblies comprise four mounting assemblies. Each of the mounting assemblies is positioned circumferentially equidistantly from each of the adjacent mounting assemblies.

The peripheral side wall 18 may be formed to include an annular groove 40 (see FIG. 5) that accommodates a ring seal member 42 that is most preferably formed of an elastomeric material. The ring seal member 42 is designed to abut against the outer surface of a drain pipe 44 inserted into the drain sleeve for creating a sealing or blocking relationship between the pipe and the peripheral side wall of the drain sleeve.

Figure 6:
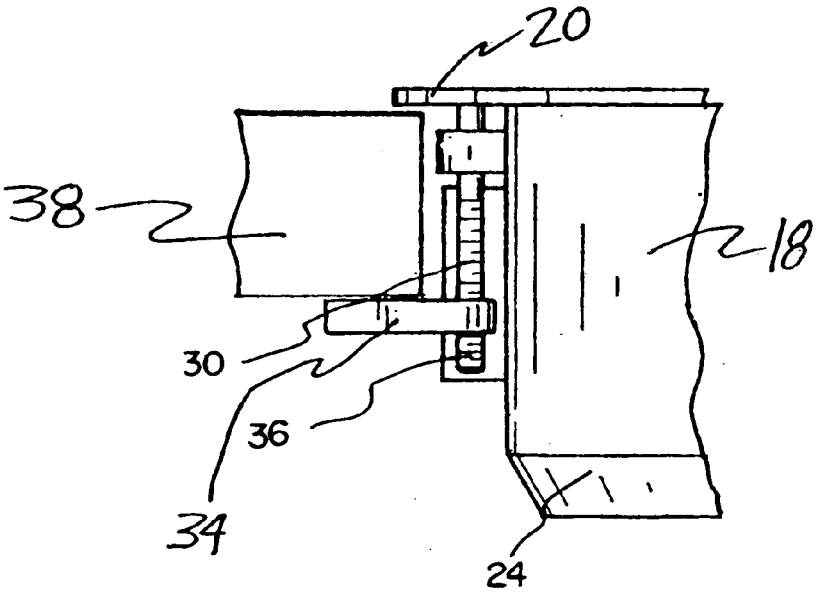
FIG. 6 is a side view of a broken-away portion of the present invention showing an optional mounting member configuration in relation to a portion of a floor of a fixture.

The mounting member may have a relatively thinner structure that may resemble a square or flat rectangular rod, such as is shown in FIG. 6 of the drawings, without any significant protrusion of a wing portion as previously described.

To use, the existing drain would be removed and the hole enlarged, if necessary, to accommodate the present invention. The underside of the peripheral flange 20 would then be coated with plumber's putty or silicone and the drain sleeve 12 is inserted into the hole until the flange 20 would seat on the stall floor 38 surrounding the hole. The present invention could then be secured in place by tightening the rods 30. Specifically, this action would cause the wing portions 32 to pivot into radially-oriented positions and draw them snug against an underside of the shower stall floor 38.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A drain replacement device for replacing a drain in a drain hole of a fixture, the drain replacement device comprising:

a drain sleeve for inserting into a drain hole of a fixture, the drain sleeve having an open upper end, an open lower end and a peripheral side wall extending between the upper and lower ends, a peripheral flange extending outwardly from the upper end for resting on a portion of the fixture adjacent to the drain hole;

a plurality of mounting assemblies for securing the drain sleeve in the drain hole of the fixture, each of the mounting assemblies comprising:

an aperture in the flange of the drain sleeve;

a support sleeve mounted on an outer surface of the peripheral side wall of the drain sleeve, the support sleeve having a lumen extending through the support sleeve;

a rod extending through the aperture in the flange and through the lumen of the support sleeve, the rod being rotatable with respect to the flange, the rod having a portion with a threaded exterior surface;

a mounting member rotatably mounted on the rod, the mounting member being rotatable by rotation of the rod between a retracted position and an extended position, the retracted position being characterized by the mounting member being positioned adjacent to the peripheral side wall, the retracted position permitting insertion of the drain sleeve into the drain hole, the extended position being characterized by the mounting member being extended substantially radially outward from the peripheral side wall for permitting an engaging surface of the mounting member to engage the underside of a rim about the drain hole in the fixture; and a rib extending radially outward from an outer surface of the peripheral side wall, the rib restricting the rotation of the mounting member beyond the extended position;

wherein rotation of the rod rotates the mounting member from a retracted position to an extended position abutted against the rib, and further rotation of the rod advances the mounting member toward the flange for pinching the rim of the drain hole between the flange and the mounting member.

2. The drain replacement device of claim 1 wherein the mounting member includes a receiving portion for mounting on the rod, the receiving portion having a hole therein for receiving a portion of the rod, the receiving portion engaging the threaded exterior surface of the portion of the rod such that rotation of the rod advances the mounting member toward the flange.

3. The drain replacement device of claim 2 wherein the mounting member has a wing portion mounted on the receiving portion, the wing portion extending from the receiving portion toward the flange.

4. The drain replacement device of claim 1 wherein the lumen of the support sleeve has a longitudinal axis passing through a center of the aperture of the flange.

5. The drain replacement device of claim 1 wherein the rib is circumferentially offset with respect to the aperture in the flange, the rib being positioned to block rotation of the mounting member beyond the extended position.

6. The drain replacement device of claim 1 wherein the rod has a head portion at one end of the rod for positioning adjacent to the flange, the head portion being enlarged to resist movement of the head portion through the aperture toward the support sleeve.

7. The drain replacement device of claim 6 wherein the head portion of the rod has a recess therein for accepting a portion of a tool for permitting rotation of the rod by the tool.

8. The drain replacement device of claim 1 wherein the plurality of mounting assemblies comprise four mounting assemblies, each of the mounting assemblies being positioned circumferentially equidistantly from each of the adjacent mounting assemblies.

9. The drain replacement device of claim 1 wherein the peripheral side wall has an outer surface and a thickness, the thickness of the peripheral side wall tapering toward the lower end of the drain sleeve for facilitating insertion of the lower end into the drain hole of the fixture.

10. The drain replacement device of claim 1 wherein an annular groove is formed in an interior surface of the perimeter side wall, and a seal ring member is located in the annular groove for abutting a drain pipe extended into the drain sleeve and forming a seal between the perimeter side wall and the drain pipe.

11. A drain replacement device for replacing a drain in a drain hole of a fixture, the drain replacement device comprising:

a drain sleeve for inserting into a drain hole of a fixture, the drain sleeve having an open upper end, an open lower end and a peripheral side wall extending between the upper and lower ends, a peripheral flange extending outwardly from the upper end for resting on a portion of the fixture adjacent to the drain hole, the peripheral side wall having an outer surface and a thickness, the thickness of the peripheral side wall tapering toward the lower end of the drain sleeve for facilitating insertion of the lower end into the drain hole of the fixture;

a plurality of mounting assemblies for securing the drain sleeve in the drain hole of the fixture, each of the mounting assemblies comprising:

an aperture in the flange of the drain sleeve;

a support sleeve mounted on the outer surface of the peripheral side wall of the drain sleeve, the support sleeve having a lumen extending through the support sleeve, the lumen having a longitudinal axis passing through a center of the aperture of the flange;

a rod extending through the aperture in the flange and through the lumen of the support sleeve, the rod having a portion with a threaded exterior surface, the rod having a head portion at one end of the rod for positioning adjacent to the flange, the head portion being enlarged to resist movement of the head portion through the aperture toward the support sleeve the rod being rotatable with respect to the flange, the head portion of the rod having a recess therein for accepting a portion of a tool for permitting rotation of the rod by the tool;

a mounting member rotatably mounted on the rod, the mounting member including a receiving portion for mounting on the rod, the receiving portion having a hole therein for receiving a portion of the rod, the receiving portion engaging the threaded exterior surface of the portion of the rod such that rotation of the rod advances the mounting member toward the flange, the mounting member having a wing portion mounted on the receiving portion, the wing portion extending from the receiving portion toward the flange, the mounting member being rotatable by rotation of the rod between a retracted position and an extended position; the retracted position being characterized by the wing portion being positioned adjacent to the peripheral side wall, the retracted position permitting insertion of the drain sleeve into the drain hole, the extended position being characterized by the wing portion being extended substantially radially outward from the peripheral side wall for permitting an engaging surface of the wing member to engage the underside of a rim about the drain hole in the fixture; and a rib extending radially outward from an outer surface of the peripheral side wall, the rib restricting the rotation of the mounting member, the rib being circumferentially offset with respect to the aperture in the flange, the rib being positioned to block rotation of the wing portion of the mounting member beyond the extended position;

wherein rotation of the rod rotates the wing portion of the mounting member from a retracted position to an extended position abutted against the rib, and further rotation of the rod advances the wing portion of the mounting member toward the flange for pinching the rim of the drain hole between the flange and the engaging surface of the mounting member.

12. The drain replacement device of claim 11 wherein the plurality of mounting assemblies comprises four mounting assemblies.

* * * * *